US010283908B1

(12) United States Patent
Simmons

(10) Patent No.: US 10,283,908 B1
(45) Date of Patent: May 7, 2019

(54) CONNECTOR WITH RELEASABLE LATCH MEMBER

(71) Applicant: TE CONNECTIVITY CORPORATION, Berwyn, PA (US)

(72) Inventor: Randy Gray Simmons, Winston Salem, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/889,679

(22) Filed: Feb. 6, 2018

(51) Int. Cl.
*H01R 13/627* (2006.01)
*H01R 13/635* (2006.01)
*H01R 13/58* (2006.01)

(52) U.S. Cl.
CPC ..... *H01R 13/635* (2013.01); *H01R 13/5816* (2013.01); *H01R 13/6273* (2013.01)

(58) Field of Classification Search
CPC ..... H01R 13/635; H01R 13/6273; H01R 13/5816
USPC ..... 439/352, 353, 357, 358, 372
See application file for complete search history.

(56) References Cited

U.S. PATENT DOCUMENTS 4,919,627 A * 4/1990 Cable ..... H01R 39/64 439/180
5,011,424 A * 4/1991 Simmons ..... H01R 13/6275 439/352
5,112,243 A * 5/1992 Chow ..... H01R 13/6275 439/352
5,154,629 A * 10/1992 Carver ..... G02B 6/3817 439/352
5,197,901 A * 3/1993 Hashiguchi ..... H01R 13/6275 439/352
5,201,669 A * 4/1993 Lin ..... H01R 13/6275 439/350
5,449,298 A * 9/1995 Fetterolf, Sr. ..... H01R 13/6275 439/350
5,588,864 A * 12/1996 Lin ..... H01R 13/6275 439/357
5,800,196 A * 9/1998 Rudoy ..... H01R 24/84 439/284
6,149,451 A * 11/2000 Weber ..... H01R 13/6275 439/358
7,507,103 B1 * 3/2009 Phillips ..... G02B 6/4201 439/352
7,534,125 B1 * 5/2009 Schroll ..... H01R 13/6275 439/157

(Continued)

*Primary Examiner* — Abdullah A Riyami
*Assistant Examiner* — Nelson R. Burgos-Guntin

(57) ABSTRACT

An electrical connector includes a housing that holds multiple electrical conductors, a latch member pivotably coupled to an outer surface of the housing, and a shell surrounding the housing. The latch member includes stem extending between a front end and an opposite rear end. The latch member has a hook tip at the front end, a ramp surface at the rear end, and a pivot location disposed therebetween. The hook tip couples to a locking tab of a mating connector. A ridge of the shell protrudes inward from an interior surface of the shell and engages the ramp surface. Rearward movement of the shell causes the latch member to pivot from a locking position to a release position due to sliding engagement between the ridge and the ramp surface. The hook tip is disposed more proximate to the housing in the locking position than in the release position.

20 Claims, 4 Drawing Sheets

(56) References Cited

U.S. PATENT DOCUMENTS

| | | | | |
|---|---|---|---|---|
| 8,506,315 | B2 * | 8/2013 | Canedo | H01R 13/60 439/310 |
| 8,672,709 | B2 * | 3/2014 | Dietz | H01R 13/6395 439/352 |
| 2006/0223355 | A1 * | 10/2006 | Hirschmann | H01R 13/6273 439/352 |
| 2012/0309218 | A1 * | 12/2012 | Annecke | H01R 13/6273 439/352 |
| 2013/0084731 | A1 * | 4/2013 | Gong | H01R 13/633 439/353 |
| 2014/0235092 | A1 * | 8/2014 | Akuta | H01R 13/6581 439/353 |
| 2014/0308009 | A1 * | 10/2014 | Mulfinger | G02B 6/3893 385/75 |
| 2014/0322952 | A1 * | 10/2014 | Ohmura | H01R 13/6275 439/352 |
| 2015/0249304 | A1 * | 9/2015 | Henry | H01R 13/6275 439/372 |

* cited by examiner

CONNECTOR WITH RELEASABLE LATCH MEMBER

BACKGROUND OF THE INVENTION

The subject matter herein relates generally to electrical connectors that releasably mate to one another via latching mechanisms.

Electrical connectors provide communicative interfaces between electrical components to transmit power and/or signals therethrough. For example, the electrical connectors may be used within telecommunication equipment, servers, and data storage or transport devices. Some electrical connectors include latching mechanisms configured to secure two connectors in a mated configuration to maintain a conductive signal path through the connectors.

However, the latching mechanisms of some electrical connectors are not designed with the ability for a simple, controlled release of the mated connectors. For example, in order to disconnect two connectors, some latching mechanisms require a user to locate a deflectable latch and pry the latch off of a catch surface via the use of a tool or the user's fingers. It may be difficult for a user to locate, access, and properly actuate the latch to disconnect the connectors. Furthermore, in use, two mated connectors may experience an axial pull force that pulls one of the connectors away from the other connector. The latching mechanisms are configured to resist such axial pull forces. However, if an axial pull force exceeds an axial force resistance upper limit of the latching mechanism, then the connectors will be disconnected and the latching mechanism and/or other components of the connectors may be damaged.

Accordingly, there is a need for an electrical connector that offers simple, releasable coupling to a mating connector.

BRIEF DESCRIPTION OF THE INVENTION

In one embodiment, an electrical connector is provided that includes a housing, a latch member, and a shell. The housing holds multiple electrical conductors that are terminated to a cable extending from a cable end of the housing. The latch member is pivotably coupled to an outer surface of the housing via an axle. The latch member includes an elongated stem extending between a front end and an opposite rear end. The latch member includes a hook tip at the front end configured to couple to a locking tab of a mating connector. The latch member includes an actuator segment at the rear end. The actuator segment has a ramp surface. The latch member is pivotably coupled to the housing at a pivot location between the hook tip and the actuator segment along a length of the stem. The shell surrounds the housing. The shell includes a ridge protruding inward from an interior surface of the shell. The ridge engages the ramp surface of the actuator segment. Rearward movement of the shell causes the latch member to pivot from a locking position to a release position due to sliding engagement between the ridge and the ramp surface. The hook tip is disposed more proximate to the housing in the locking position than in the release position.

In another embodiment, a connector system is provided that includes a plug connector and a receptacle connector. The plug connector includes a plug housing, a latch member, and a shell. The plug housing holds multiple electrical conductors. The latch member is pivotably coupled to an outer surface of the plug housing. The latch member includes an elongated stem extending between a front end and an opposite rear end. The latch member includes a hook tip at the front end and a ramp surface at the rear end. The latch member is pivotably coupled to the housing at a pivot location between the hook tip and the ramp surface along a length of the stem. The shell surrounds the housing. The shell includes a ridge protruding inward from an interior surface of the shell and engaging the ramp surface. The receptacle connector includes a receptacle housing that holds multiple electrical conductors. The receptacle housing defines a socket at a mating end of the receptacle housing. The receptacle connector includes a locking tab on an outer surface of the receptacle housing. In a mated configuration, the plug housing is received within the socket of the receptacle housing, and the electrical conductors of the plug connector engage the electrical conductors of the receptacle connector. The hook tip of the latch member is latched to the locking tab in a locking position of the latch member to secure the plug housing to the receptacle housing. Rearward movement of the shell away from the receptacle connector causes the latch member to pivot from the locking position to a release position due to sliding engagement between the ridge and the ramp surface. The hook tip is unlatched from the locking tab in the release position.

In another embodiment, an electrical connector is provided that includes a housing, a latch member, a shell, and a tether. The housing holds multiple electrical conductors that are terminated to a cable extending from a cable end of the housing. The latch member is pivotably coupled to an outer surface of the housing. The latch member includes an elongated stem extending between a front end and an opposite rear end. The latch member includes a hook tip at the front end configured to couple to a locking tab of a mating connector. The latch member includes an actuator segment at the rear end. The actuator segment has a ramp surface. The latch member is pivotably coupled to the housing at a pivot location that is between the hook tip and the actuator segment along a length of the stem. The shell surrounds the housing. The shell includes a ridge protruding inward from an interior surface of the shell. The ridge engages the ramp surface of the actuator segment. The tether is connected to the shell and extends rearward from a rear end of the shell. The tether is configured to pull the shell rearward, causing the latch member to pivot from a locking position to a release position due to sliding engagement between the ridge and the ramp surface.

DETAILED DESCRIPTION OF THE INVENTION

Figure 1:
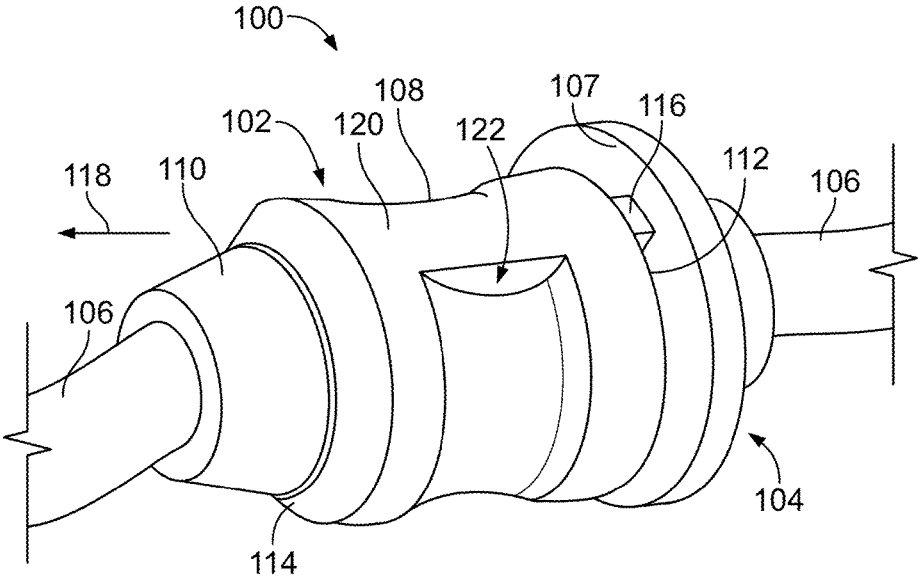
FIG. 1 is a perspective view of a connector system according to an embodiment showing a first electrical connector mated to a second or mating electrical connector.

FIG. 1 is a perspective view of a connector system 100 according to an embodiment showing a first electrical connector 102 mated (e.g., connected) to a second or mating electrical connector 104. The first electrical connector 102 is referred to herein as a plug connector 102, and the second electrical connector 104 is referred to as a receptacle connector 104. In the illustrated embodiment, both connectors 102, 104 are cable-mounted such that each of the connectors 102, 104 includes an electrical cable 106 extending therefrom. Each cable 106 includes one or more electrical wires. For example, each cable 106 may represent a single wire, multiple wires bound together to form a wire harness or cable harness, or multiple wires that are not bound together. Optionally, the receptacle connector 104 may configured to mount directly to a structure, such as a chassis or panel wall of an electrical device. For example, a flange 107 of the connector 104 may be bonded or fastened to a panel wall such that the connector 104 extends through an opening in the wall. In an alternative embodiment, the receptacle connector 104 may be a board-mounted connector that is mounted to a printed circuit board instead of to the respective cable 106.

In the mated configuration shown in FIG. 1, an electrically-conductive signal path is established between the connectors 102, 104 for transmitting power and/or signals through the connectors 102, 104. The connectors 102, 104 are used to electrically connect the electrical cables 106 (and electrical devices at distal ends of the cables 106) together. The connector system 100 may be housed within an electronic device, such as a server, a computer, or the like. In one embodiment, the connector system 100 is installed on a vehicle, such as an automobile, a marine vessel, a rail vehicle, an off-highway vehicle, or the like. The connectors 102, 104 may be high speed connectors that are configured to transmit electrical current at frequencies up to or exceeding 10 Gbps.

The plug connector 102 includes a shell or cover 108 and a cable strain relief bushing 110. The shell 108 extends from a front end 112 to an opposite rear end 114. As used herein, relative or spatial terms such as "front," "rear," "top," "bottom," "left," and "right" are only used to distinguish the referenced elements and do not necessarily require particular positions or orientations in the connector system 100 or in the surrounding environment of the connector system 100. The front end 112 is located proximate to the receptacle connector 104. The cable strain relief bushing 110 is mounted to the rear end 114 of the shell 108. The cable 106 protrudes from the plug connector 102 through the cable strain relief bushing 110. The strain relief bushing 110 is configured to protect the cable 106 and the connector 102 by reducing strain at the interface between the cable 106 and the connector 102 due to pulling the cable 106 in various angles relative to the connector 102.

The plug connector 102 is secured to the receptacle connector 104 via a latch member 116 disposed within the shell 108. In the illustrated embodiment, an end of the latch member 116 protrudes beyond the front end 112 of the shell 108 and latches to a corresponding catch surface on the receptacle connector 104. As described in more detail herein, the latch member 116 is configured to release from the catch surface of the receptacle connector 104 to allow the connectors 102, 104 to disconnect in response to rearward movement of the shell 108. For example, pulling (or pushing) the shell 108 in a rearward direction 118 (e.g., away from the receptacle connector 104) causes the latch member 116 to release the catch surface of the receptacle connector 104. The shell 108 may be moved rearward by a user grasping and pulling the shell 108 directly. An exterior surface 120 of the shell 108 may have an ergonomic contour designed to accommodate a user's fingers. The ergonomic contour of the shell 108 in the illustrated embodiment is generally cylindrical and includes an annular groove or depression 122. Although the shell 108 is generally cylindrical in FIG. 1, the plug connector 102 may have other shapes in other embodiments, such as a prism or box shape. Optionally, the plug connector 102 may include a tether 124 (shown in FIG. 5) that is connected (directly or indirectly) to the shell 108. The shell 108 may be moved rearward due to tension in the tether 124. For example, a user may pull the tether 124 directly, or may pull the tether 124 indirectly by moving a structure that is attached to a distal end of the tether 124. For example, if the distal end of the tether 124 is secured to a removable door on an automobile, the removal of the door may cause the tether 124 to pull the shell 108 rearward, releasing the plug connector 102 from the receptacle connector 104 without damaging either connector 102, 104.

Figure 2:
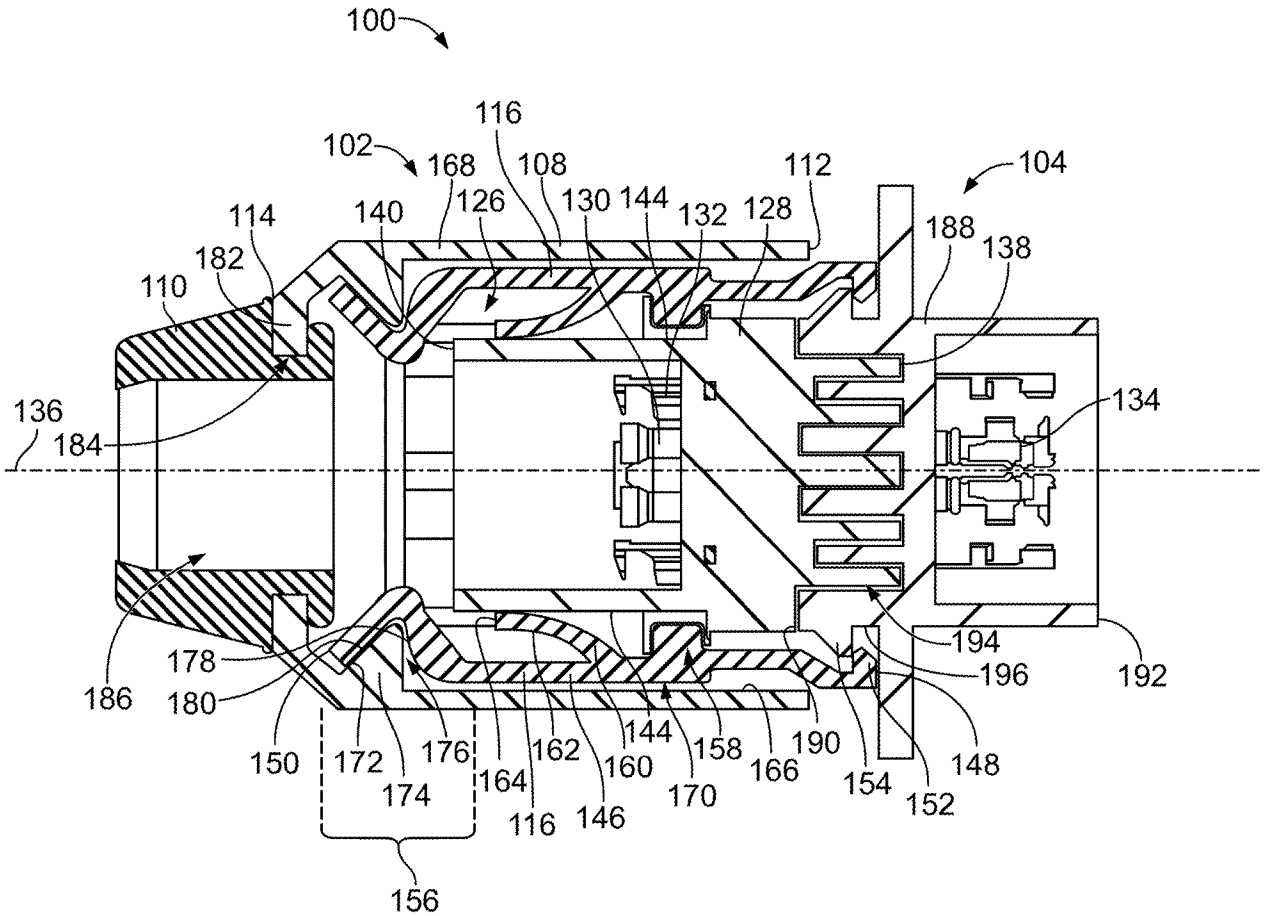
FIG. 2 is a cross-sectional view of the connector system according to an embodiment.

FIG. 2 is a cross-sectional view of the connector system 100 according to an embodiment. As in FIG. 1, the plug connector 102 is shown in a mating configuration with the receptacle connector 104. The cables 106 of the connectors 102, 104 are not shown in FIG. 2. The shell 108 of the plug connector 102 defines a cavity 126. The plug connector 102 includes a plug housing 128 that is disposed within the cavity 126. The plug housing 128 holds multiple electrical conductors 130. The electrical conductors 130 in the illustrated embodiment include crimp barrels 132 configured to be crimped around corresponding wires of the cable 106 (FIG. 1). In an alternative embodiment, the conductors 130 may be electrically connected to the cable 106 via soldering or the like instead of crimping. The electrical conductors 130 include contact portions or terminals (not shown) that engage and electrically connect to corresponding electrical conductors 134 of the receptacle connector 104 when in the mated configuration. The plug housing 128 extends axially along a central axis 136 between a mating end 138 and an opposite cable end 140. The cable 106 (FIG. 1) extends from the cable end 140 of the housing 128. The mating end 138 of the housing 128 protrudes beyond the front end 112 of the shell 108 in the illustrated embodiment.

The plug connector 102 further includes the latch member 116 that is pivotably coupled to an outer surface 144 of the plug housing 128. The plug connector 102 includes two latch members 116 in the illustrated embodiment, but may include one, three, or more than three latch members 116 in alternative embodiments. The two latch members 116 are spaced apart from each other along a perimeter of the housing 128. For example, the two latch members 116 in FIG. 2 are located on opposite sides of the housing 128 or are located 180 degrees apart from each other. The latch members 116 are identical or at least substantially similar to each other, such that the following description applies to both latch members 116.

The latch member 116 has an elongated stem 146 that extends between a front end 148 and an opposite rear end 150. The latch member 116 includes a hook tip 152 at the front end 148. The hook tip 152 couples to a locking tab 154 of the receptacle connector 104 to secure the plug connector 102 to the receptacle connector 104. The latch member 116 includes an actuator segment 156 at least proximate to the rear end 150. The actuator segment 156 is configured to receive an applied force, which may cause the latch member 116 to pivot if the applied force overcomes a resistive or biasing force of the latch member 116. The latch member 116 is mounted or coupled to the plug housing 128 at a pivot location 158 of the latch member 116. The pivot location 158 is disposed between the hook tip 152 and the actuator segment 156 along the length of the stem 146. The latch member 116 pivots relative to the housing 128 at the pivot location 158. Since the pivot location 158 is axially between the hook tip 152 and the actuator segment 156, inward movement of the actuator segment 156 (e.g., towards the central axis 136) causes the hook tip 152 to move outward (e.g., away from the central axis 136), and vice-versa.

Figure 4:
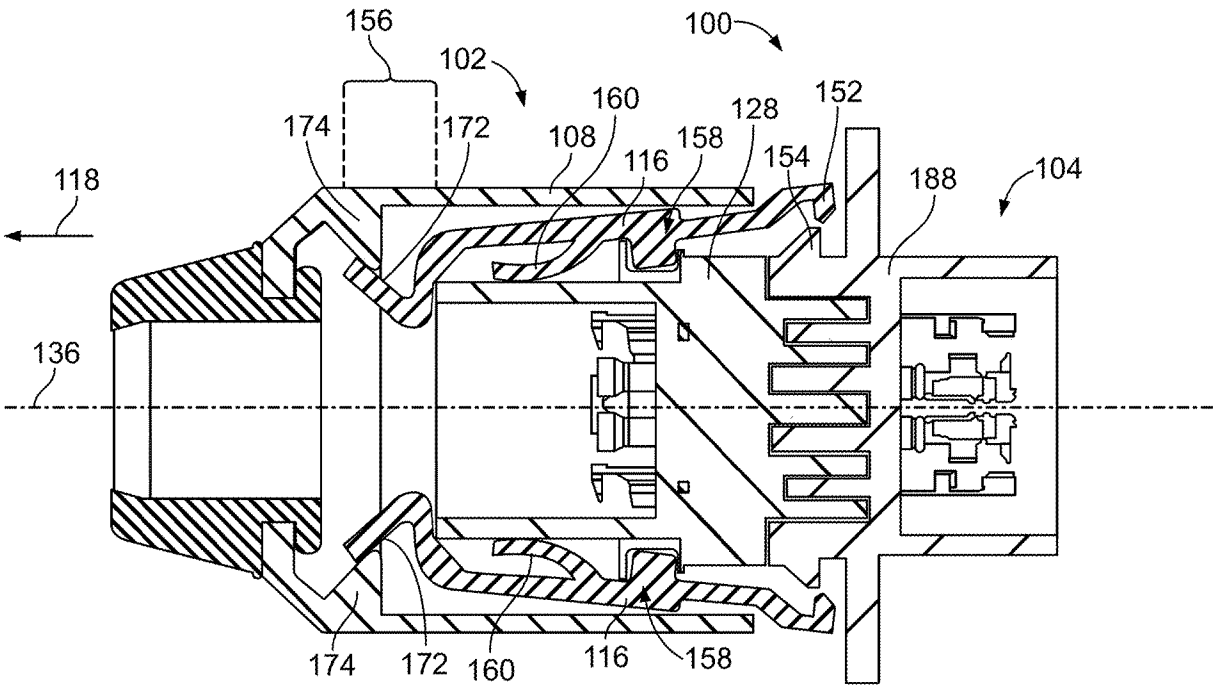
FIG. 4 is a cross-sectional view of the connector system according to an embodiment showing latch members of the first electrical connector in a release position.

The latch member 116 is configured to pivot between a locking position and a release position. The hook tip 152 is configured to latch onto the locking tab 154 of the receptacle connector 104 when in the locking position. The latch member 116 is in the locking position in FIG. 2, as the hook tip 152 is latched to the locking tab 154. When the latch member 116 is pivoted to the release position (as shown in FIG. 4), the hook tip 152 disengages the locking tab 154. When all latch members 116 of the plug connector 102 are in the release position, the plug connector 102 is released from the receptacle connector 104 such that the connectors 102, 104 can be pulled apart and unmated.

The latch member 116 further includes a deflectable return spring beam 160 that extends from the stem 146 at a location between the pivot location 158 and the actuator segment 156 along the length of the stem 146. The return spring beam 160 has a contact segment 162 that engages the outer surface 144 of the plug housing 128 to bias the latch member 116 in the locking position. In the illustrated embodiment, the return spring beam 160 is cantilevered from the stem 146, and the contact segment 162 is at least proximate to a distal, free end 164 of the return spring beam 160. When an applied force is applied on the actuator segment 156 towards the central axis 136, the return spring beam 160 may deflect and provide a resistive force that opposes the pivoting of the latch member 116. In an alternative embodiment, the return spring beam 160 is located between the pivot location 158 and the hook tip 152, and the return spring beam 160 extends outward from the stem 146 to engage an interior surface 166 of the shell 108 to bias the latch member 116 in the locking position.

The latch member 116 is within the cavity 126 of the shell 108 and is disposed between the outer surface 144 of the plug housing 128 and the interior surface 166 of the shell 108. In an embodiment, the plug housing 128 has a generally cylindrical outer surface 144, and the shell 108 has a cylindrical body 168. The cavity 126 has a greater diameter than the housing 128, such that an annular gap 170 is defined between the outer surface 144 and the interior surface 166. The latch member 116 is disposed within the annular gap 170. In an embodiment, the front end 148 of the latch member 116 protrudes from the cavity 126 beyond the front end 112 of the shell 108. The hook tip 152 is disposed frontward of the shell 108. In an alternative embodiment, the shell 108 surrounds the front end 148 of the latch member 116.

The actuator segment 156 includes a ramp surface 172. The ramp surface 172 is angled or curved to extend laterally outward (e.g., away from the central axis 136) with increasing distance along the ramp surface 172 towards the rear end 150. Thus, the portion of the ramp surface 172 most proximate to the rear end 150 is located farther away from the central axis 136 than a proximity between the central axis 136 and the portion of the ramp surface 172 most proximate to the front end 148. The shell 108 includes a ridge 174 that protrudes inward (e.g., toward the central axis 136) from the interior surface 166 of the shell 108. The ridge 174 engages the ramp surface 172. Rearward movement of the shell 108 (relative to the plug housing 128) causes the ridge 174 to slide along the ramp surface 172, which provides an applied force on the actuator segment 156 in an inward direction. Assuming the applied force on the actuator segment 156 due to the rearward movement of the shell 108 is greater than the resistance provided by the return spring beam 160, the latch member 116 pivots from the locking position to the release position. In an embodiment, the ridge 174 is extends along a full inner perimeter of the shell 108. For example, the ridge 174 may be annular or ring-shaped if the shell 108 is cylindrical. Therefore, the ridge 174 engages the actuator segments 156 of each of the latch members 116 pivotably coupled to the plug housing 128 at spaced apart locations. Alternatively, the shell 108 may include multiple discrete ridges 174 that each engages a subset of the latch members 116 instead of one ridge 174 that engages all latch members 116. Regardless of the number of ridges 174, the rearward movement of the shell 108 is configured to pivot all of the latch members 116 equally. For example, either all of the latch members 116 pivot to the release position or none of the latch members 116 pivot to the release position (e.g., which could happen if the applied forces from the ridge(s) 174 on the actuator segments 156 do not overcome the resistance provided by the return spring beams 160).

In an embodiment, the actuator segment 156 of the latch member 116 includes a groove 176. The groove 176 is depressed inward toward the central axis 136. The ramp surface 172 defines a rear portion of the groove 176. The ridge 174 of the shell 108 is received within the groove 176. The reception of the ridge 174 within the groove 176 couples the shell 108 to the latch member 116. The reception of the ridge 174 in the groove 176 also indirectly couples the shell 108 to the plug housing 128 via the latch members 116 that are mounted to the housing 128. For example, rearward movement of the shell 108 causes the ridge 174 to abut the rear portion of the groove 176 defined by the ramp surface 172, and forward movement of the shell 108 results in the ridge 174 abutting a front portion 178 of the groove 176 defined by a curved or angled surface of the stem 146. In an embodiment, the ridge 174 has a ramp surface 180 that has a complementary angle as the ramp surface 172 of the latch member 116. The ramp surface 180 of the ridge 174 engages and slides along the ramp surface 172 when the shell 108 is moved axially.

The shell 108 extends axially beyond the cable end 140 of the plug housing 128 to the rear end 114 of the shell 108. The rear end 114 of the shell 108 is mounted to the cable strain relief bushing 110. For example, the shell 108 may include tabs or a flange 182 at the rear end 114 received within a slot 184 of the strain relief bushing 110. The strain relief bushing 110 defines a channel 186 through which the cable 106 extends to exit the cavity 126 of the plug connector 102.

The receptacle connector 104 includes a receptacle housing 188 which holds the electrical conductors 134 of the receptacle connector 104. The receptacle housing 188 extends between a mating end 190 and an opposite cable end 192. The housing 188 defines a socket 194 at the mating end 190. When the connectors 102, 104 are in the mated configuration shown in FIG. 2, the mating end 138 of the plug housing 128 and contact portions of the electrical conductors 130 are received in the socket 194. The overlap length between the mating end 138 of the plug housing 128 and the mating end 190 of the receptacle housing 188 defines a mating interface. The electrical conductors 130 engage and electrically connect to the electrical conductors 134 along the mating interface. As shown in FIG. 2, the locking tabs 154 of the receptacle connector 104 extend outward from an outer surface 196 of the receptacle housing 188.

Figure 3:
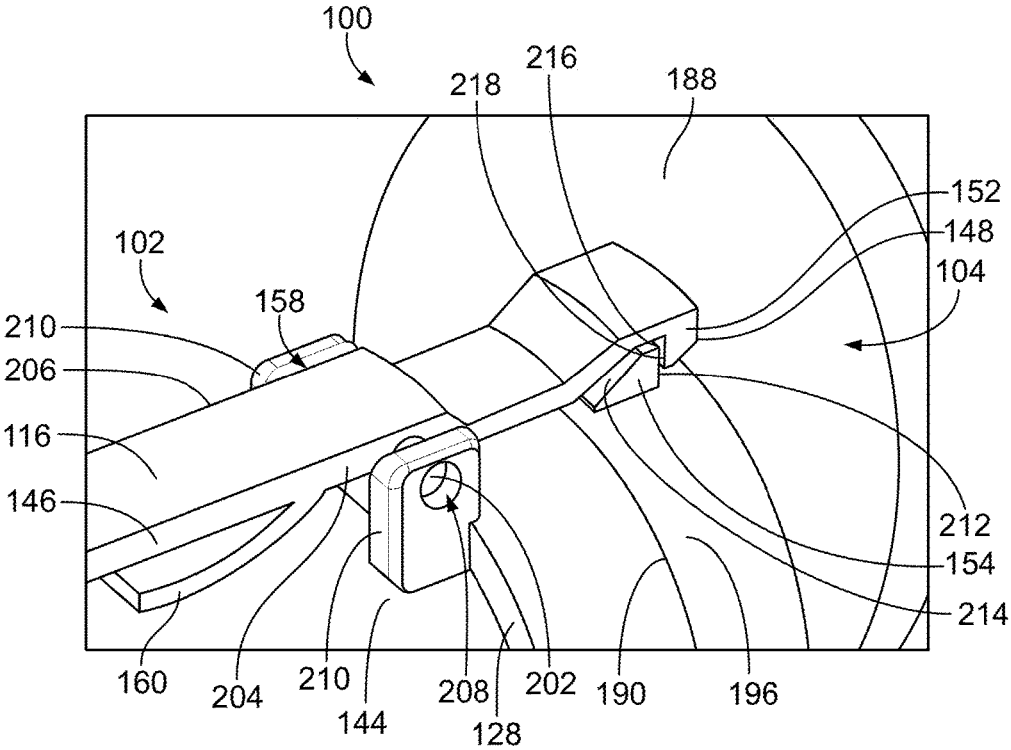
FIG. 3 is a close-up perspective view of a portion of the connector system showing the first electrical connector mated to the second electrical connector according to an embodiment.

FIG. 3 is a close-up perspective view of a portion of the connector system 100 showing the plug connector 102 mated to the receptacle connector 104 according to an embodiment. The shell 108 of the plug connector 102 is not shown in FIG. 3. The latch member 116 is pivotably coupled to the outer surface 144 of the plug housing 128 via an axle 202. In the illustrated embodiment, the axle 202 is defined by posts 202 extending from opposite first and second lateral sides 204, 206 of the latch member 116 at the pivot location 158. Only one of the posts 202 is visible in FIG. 3. The posts 202 are received in corresponding apertures 208 of support walls 210 of the housing 128. The support walls 210 extend outward from the outer surface 144. In an alternative embodiment, the support walls 210 of the housing 128 includes the axle which is received within an aperture defined within the latch member 116.

The locking tab 154 of the receptacle connector 104 includes a catch surface 212 and a ramp 214. The ramp 214 slopes towards the mating end 190 from an outer edge 216 of the catch surface 212 to the outer surface 196 of the receptacle housing 188. During a mating operation when the plug and receptacle connectors 102, 104 are moving toward each other, the hook tip 152 of the latch member 116 engages and slides along the ramp 214 of the locking tab 154, which forces the front end 148 of the latch member 116 to pivot outward from the locking position towards the release position. As the latch member 116 pivots, the return spring beam 160 deflects due to the reduced distance between the stem 146 and the outer surface 144. Once a catch surface 218 of the hook tip 152 passes beyond the outer edge 216 of the locking tab 154, the return spring beam 160 resiles and pivots the latch member 116 back to the locking position. In the locking position shown in FIG. 3, the catch surface 218 of the hook tip 152 overlaps and is configured to abut the catch surface 212 of the locking tab 154 to secure the plug connector 102 to the receptacle connector 104.

FIG. 4 is a cross-sectional view of the connector system 100 according to an embodiment showing the latch members 116 of the plug connector 102 in a release position. In an embodiment, the plug connector 102 can be disconnected from the receptacle connector 104 by moving the shell 108 in the rearward direction 118 away from the receptacle connector 104. The rearward movement of the shell 108 pivots the latch members 116 from the locking position to the release position. The latch members 116 are shown in the release position in FIG. 4. In the release position, the hook tips 152 of the latch members 116 are unlatched from the locking tabs 154 of the receptacle connector 104.

The location of the shell 108 relative to the plug housing 128 is rearward of the location of the shell 108 relative to the plug housing 128 in FIG. 2. As the shell 108 moves rearward, the ridge 174 of the shell 108 slides along the ramp surfaces 172 of the latching members 116. The angles of the ridge 174 and the ramp surface 172 redirect the rearward force to an inwardly-directed applied force on the actuator segments 156 (e.g., towards the central axis 136). The applied force exceeds the resistance provided by the return spring beams 160, causing the return spring beams 160 to deflect as the latch members 116 pivot about the pivot locations 158. As the latch members 116 pivot, the hook tips 152 move outward away from the central axis 136 until the hook tips 152 release from the locking tabs 154. The hook tips 152 are disposed more proximate to the housings 128, 188 (and the locking tabs 154) in the locking position than in the release position. In the release position shown in FIG. 4, the plug and receptacle connectors 102, 104 can be pulled apart and unmated without interference by the latch members 116.

Since rearward movement of the shell 108 can release the latch members 116, a user can simply uncouple the connectors 102, 104 by pulling directly on the shell 108, which is easily accessible, instead of having to locate and manipulate the individual latches. Furthermore, the embodiments described herein may protect the structural integrity of the connectors 102, 104 and/or the cables 106 (shown in FIG. 1) because a large axial pull force applied on the shell 108 of the plug connector 102 in the rearward direction 118 can release the latch members 116 instead of damaging the latching mechanism. For example, if a large pull force is applied to a known connector that has a latching mechanism, the latches may not release and the large force may cause the latches to bend and/or break.

Figure 5:
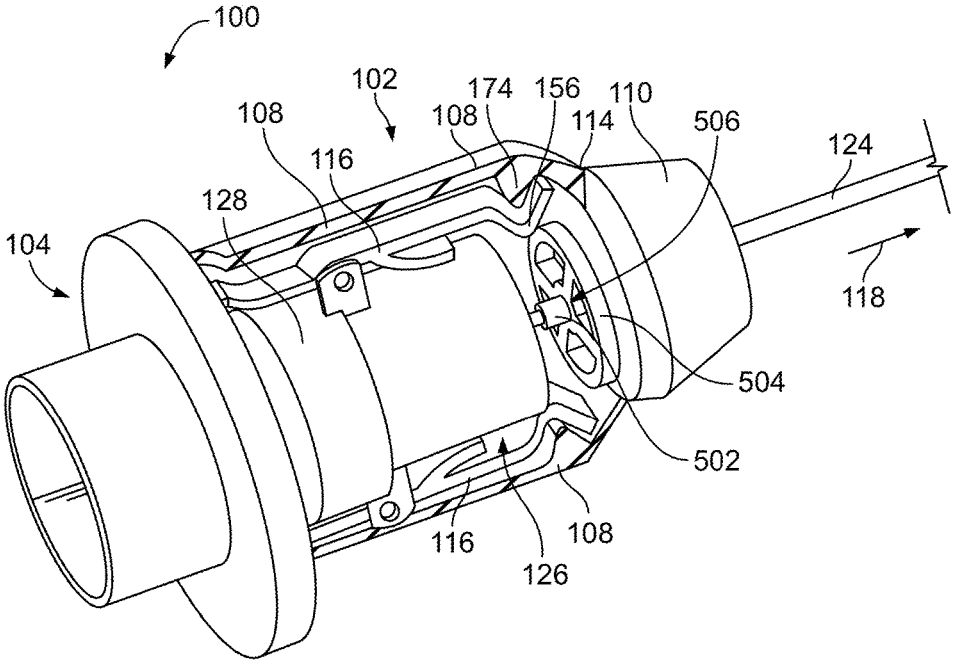
FIG. 5 is a partial cross-sectional perspective view of the connector system according to an embodiment in which the first electrical connector includes a tether.

FIG. 5 is a partial cross-sectional perspective view of the connector system 100 according to an embodiment in which the plug connector 102 includes a tether 124. In the illustrated embodiment, the shell 108 is shown in cross-section, but the other components of the connector system 100 are not in cross-section. The tether 124 is connected to the shell 108 and extends rearward from the rear end 114 of the shell 108. The tether 124 configured to pull the shell 108 rearward relative to the plug housing 128 and latch members 116 to pivot the latch members 116 from the locking position to the release position (e.g., due to the sliding engagement between the ridge 174 and the actuator segments 156 of the latch members 116).

Although the cable 106 (FIG. 1) extending from the plug connector 102 is not shown in FIG. 5, the tether 124 may be used to release the plug connector 102 from the receptacle connector 104 before tension can be applied on the one or more wires of the cable 106. For example, both the tether 124 and the cable 106 may be attached to a removable device, such as a removable door. The tether 124 has less slack between the device and the connectors 102, 104 than the cable 106. Therefore, when the removable device is moved away from the connectors 102, 104, tension is applied to the tether 124 before tension is applied to the cable 106. The tension applied to the tether 124 pulls the shell 108 rearward, releasing the latch members 116. Therefore, the plug connector 102 disconnects from the receptacle connector 104 as the removable device is moved away, without damaging either of the connectors 102, 104 or the cable 106.

In the illustrated embodiment, a proximal end 502 of the tether 124 is fixed to a ring 504 that is located within the cavity 126 of the shell 108. The ring 504 engages the rear end 114 of the shell 108 to transfer tension on the tether 124 to rearward movement of the shell 108. The ring 504 distributes the pull force along a greater area than if the tether 124 was attached directly to a portion of the shell 108. In the illustrated embodiment, the ring 504 indirectly engages the shell 108 via the cable strain relief bushing 110. The ring 504 defines openings 506 that allow the wires of the cable 106 (shown in FIG. 1) to pass through the ring 504.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing holding multiple electrical conductors that are terminated to a cable extending from a cable end of the housing;

a latch member pivotably coupled to an outer surface of the housing via an axle, the latch member including an elongated stem extending between a front end and an opposite rear end, the latch member including a hook tip at the front end configured to couple to a locking tab of a mating connector, the latch member including an actuator segment at the rear end, the actuator segment having a ramp surface, the latch member pivotably coupled to the housing at a pivot location between the hook tip and the actuator segment along a length of the stem;

a shell surrounding the housing, the shell including a ridge protruding inward from an interior surface of the shell, the ridge engaging the ramp surface of the actuator segment, and a tether connected to the shell and extending rearward from a rear end of the shell, the tether configured to pull the shell rearward relative to the housing causing the latch member to pivot from a locking position to a release position due to sliding engagement between the ridge and the ramp surface, the hook tip disposed more proximate to the housing in the locking position than in the release position.

2. The electrical connector of claim 1, wherein the latch member further includes a deflectable return spring beam extending from the stem and located between the pivot location and the actuator segment along the length of the stem, a contact segment of the return spring beam engaging the outer surface of the housing to bias the latch member in the locking position.

3. The electrical connector of claim 1, wherein the ridge of the shell includes a ramp surface that engages the ramp surface of the actuator segment, the ramp surface of the ridge extending at a complementary angle relative to the ramp surface of the actuator segment, the ramp surface of the ridge sliding along the ramp surface of the actuator segment responsive to rearward movement of the shell.

4. The electrical connector of claim 1, wherein the outer surface of the housing is cylindrical, the shell having a cylindrical body, the latch member disposed in an annular gap between the outer surface of the housing and the interior surface of the shell.

5. The electrical connector of claim 1, wherein the actuator segment of the latch member includes a groove, the ramp surface defining a rear portion of the groove, the ridge of the shell received in the groove.

6. The electrical connector of claim 1, wherein the rear end of the shell is secured to a cable strain relief bushing, the cable strain relief bushing defining a channel through which the cable extends.

7. The electrical connector of claim 1, wherein the latch member is a first latch member, the electrical connector further including a second latch member pivotably coupled to the outer surface of the housing at a location that is spaced apart along a perimeter of the housing from the first latch member.

8. The electrical connector of claim 1, wherein the shell includes a front end, the latch member protruding from the front end of the shell such that the hook tip is disposed frontward of the shell.

9. The electrical connector of claim 1, wherein, responsive to the shell moving rearward relative to the housing, the ridge forces the actuator segment inward towards a central axis of the housing, the latch member pivoting about the axle such that the hook tip moves outward away from the central axis.

10. The electrical connector of claim 1, wherein the ramp surface of the latch member is angled to extend laterally outward with increasing distance towards the rear end of the stem.

11. A connector system comprising:

a plug connector including a plug housing, a latch member, a shell, and a tether, the plug housing holding multiple electrical conductors, the latch member pivotably coupled to an outer surface of the plug housing, the latch member including an elongated stem extending between a front end and an opposite rear end, the latch member including a hook tip at the front end and a ramp surface at the rear end, the latch member pivotably coupled to the housing at a pivot location between the hook tip and the ramp surface along a length of the stem, the shell surrounding the housing, the shell including a ridge protruding inward from an interior surface of the shell and engaging the ramp surface, the tether connected to the shell and extending rearward from a rear end of the shell; and a receptacle connector including a receptacle housing that holds multiple electrical conductors, the receptacle housing defining a socket at a mating end of the receptacle housing, the receptacle connector including a locking tab on an outer surface of the receptacle housing, wherein in a mated configuration the plug housing is received within the socket of the receptacle housing and the electrical conductors of the plug connector engage the electrical conductors of the receptacle connector, the hook tip of the latch member latched to the locking tab in a locking position of the latch member to secure the plug housing to the receptacle housing, and wherein the tether is configured to pull the shell rearward relative to the housing away from the receptacle connector causing the latch member to pivot from the locking position to a release position due to sliding engagement between the ridge and the ramp surface, the hook tip unlatched from the locking tab in the release position.

12. The connector system of claim 11, wherein the hook tip of the latch member of the plug connector is disposed more proximate to the outer surface of the receptacle housing in the locking position than in the release position.

13. The connector system of claim 11, wherein the latch member further includes a deflectable return spring beam extending from the stem and located between the pivot location and the ramp surface along the length of the stem, a contact segment of the return spring beam engaging the outer surface of the plug housing to bias the latch member in the locking position.

14. The connector system of claim 11, wherein the stem of the latch member includes a groove, the ramp surface defining a rear portion of the groove, the ridge of the shell received in the groove.

15. The connector system of claim 11, wherein the locking tab includes a catch surface and a ramp extending from an outer edge of the catch surface to the outer surface of the receptacle housing proximate to the mating end, the latch member pivoting from the locking position as the hook tip slides along the ramp towards the catch surface to mate the plug connector to the receptacle connector.

16. An electrical connector comprising:

a housing holding multiple electrical conductors that are terminated to a cable extending from a cable end of the housing;

a latch member pivotably coupled to an outer surface of the housing, the latch member including an elongated stem extending between a front end and an opposite rear end, the latch member including a hook tip at the front end configured to couple to a locking tab of a mating connector, the latch member including an actuator segment at the rear end, the actuator segment having a ramp surface, the latch member pivotably coupled to the housing at a pivot location that is between the hook tip and the actuator segment along a length of the stem;

a shell defining a cavity, the shell surrounding the housing that is disposed within the cavity, the cavity extending axially beyond the cable end of the housing to a rear end of the shell, the shell including a ridge protruding inward from an interior surface of the shell, the ridge engaging the ramp surface of the actuator segment; and a tether including a proximal end that is fixed to a ring located within the cavity of the shell, the ring engaging the rear end of to the shell, the tether extending rearward from the rear end of the shell, the tether configured to pull the shell rearward via the ring that transfers tension on the tether to rearward movement of the shell, causing the latch member to pivot from a locking position to a release position due to sliding engagement between the ridge and the ramp surface.

17. The electrical connector of claim 16, wherein the rear end of the shell is secured to a cable strain relief bushing, the cable strain relief bushing defining a channel through which the cable extends.

18. The electrical connector of claim 16, wherein, responsive to the shell moving rearward, the ridge forces the actuator segment inward towards a central axis of the housing, the latch member pivoting at the pivot location such that the hook tip moves outward away from the central axis.

19. The electrical connector of claim 16, wherein the electrical conductors are terminated to different corresponding wires of the cable, the ring defining openings therethrough, the wires of the cable pass through the ring within the openings.

20. The electrical connector of claim 16, wherein the ring has a hub at a center of the ring and an annulus at a radial perimeter of the ring, the proximal end of the tether fixed to the hub, the annulus of the ring engaging the rear end of the shell to distribute a pull force on the tether along an engagement surface area between the annulus and the rear end of the shell.

* * * * *